US012533770B2

(12) United States Patent
Lin

(10) Patent No.: US 12,533,770 B2
(45) Date of Patent: Jan. 27, 2026

(54) VIBRATING STONE GRINDER

(71) Applicant: Shaojuan Lin, Shantou (CN)

(72) Inventor: Shaojuan Lin, Shantou (CN)

( * ) Notice: Subject to any disclaimer, the term of this patent is extended or adjusted under 35 U.S.C. 154(b) by 382 days.

(21) Appl. No.: 18/222,273

(22) Filed: Jul. 14, 2023

(65) Prior Publication Data

US 2025/0018520 A1 Jan. 16, 2025

(51) Int. Cl.

| | |
|---|---|
| ***B24B 31/06*** | (2006.01) |
| ***B24B 31/067*** | (2006.01) |
| ***B24B 31/073*** | (2006.01) |
| ***B24B 31/104*** | (2006.01) |
| ***B24B 35/00*** | (2006.01) |

(52) U.S. Cl.

CPC ..... *B24B 35/005* (2013.01); *B24B 31/06* (2013.01); *B24B 31/067* (2013.01); *B24B 31/073* (2013.01); *B24B 31/104* (2013.01)

(58) Field of Classification Search

CPC ..... B24B 31/06; B24B 31/067; B24B 31/073; B24B 31/104; B24B 31/027

USPC ..... 451/32, 104, 113, 326, 327, 328

See application file for complete search history.

(56) References Cited

U.S. PATENT DOCUMENTS

| | | | | |
|---|---|---|---|---|
| 3,893,266 A * | 7/1975 | Anderson | B24B 31/073 | 451/327 |
| 4,387,539 A * | 6/1983 | Fewel | B24B 31/06 | 384/107 |
| 5,036,623 A * | 8/1991 | Alonzo | B24B 31/073 | 451/104 |
| 5,375,377 A * | 12/1994 | Kenton | B24B 31/06 | 451/22 |
| 6,210,258 B1 * | 4/2001 | Malkin | B24B 31/073 | 451/328 |
| 6,231,426 B1 * | 5/2001 | Liao | B24B 31/102 | 451/326 |
| 7,883,396 B2 * | 2/2011 | Potterfield | B24B 31/073 | 451/328 |
| 8,550,882 B2 * | 10/2013 | Shim | B24B 11/02 | 15/21.2 |

* cited by examiner

*Primary Examiner* — Makena S Markman
(74) *Attorney, Agent, or Firm* — Birchwood IP

(57) ABSTRACT

A vibrating stone grinder, comprising a lower housing, an upper housing and a control panel, wherein the upper housing is fixedly connected to an upper surface of the lower housing, a protective cover is arranged on an inner wall of the upper housing, and the control panel is arranged at a joint position of the upper housing and the lower housing, wherein the control panel comprises a assembly main board, the assembly main board is bolted to the inner wall of the lower housing, a surface of the assembly main board is fixedly connected with a display screen, a power switch, an acceleration button, a deceleration button, and an adjustment button.

5 Claims, 6 Drawing Sheets

VIBRATING STONE GRINDER

TECHNICAL FIELD

The present application relates to the technical field of stone processing, in particular to a vibrating stone grinder.

BACKGROUND

In the process of stone processing, it is often necessary to use a grinder to grind it to ensure the smoothness of the surface of the stone after processing. The staff performs grinding operations by operating the grinder.

The inventor found in daily work that in the process of grinding stones, the grinding of existing stones is mostly done manually. In the actual grinding process, due to the slight differences in manual grinding, some rough parts will remain on the surface of the stone after grinding. Simultaneously, the time spent in the grinding process is longer, resulting in relatively low grinding efficiency of the stone, and the labor cost consumed by manual grinding is higher, resulting in an increase in the processing cost of the stone.

SUMMARY

The purpose of the present application is to propose a kind of vibrating stone grinder, in order to solve the shortcomings in the prior art that the grinding process takes a long time, resulting in relatively low grinding efficiency of the stone, and the labor cost of manual grinding is relatively high, resulting in an increase in the processing cost of the stone.

In order to achieve the above object, the present application adopts the following technical solutions: A vibrating stone grinder, comprising a lower housing, an upper housing and a control panel, wherein the upper housing is fixedly connected to an upper surface of the lower housing, a protective cover is arranged on an inner wall of the upper housing, and the control panel is arranged at a joint position of the upper housing and the lower housing, wherein the control panel comprises a assembly main board, the assembly main board is bolted to the inner wall of the lower housing, a surface of the assembly main board is fixedly connected with a display screen.

Preferably, the surface of the assembly main board is fixedly connected with a power switch, the surface of the assembly main board is fixedly connected with an acceleration button, and the surface of the assembly main board is fixedly connected with a deceleration button, and the surface of the assembled main board is fixedly connected with an adjustment button. The power switch is provided, and the running state of the device can be controlled through the power switch, so as to realize the work of the device.

Preferably, the display screen is electrically connected to the power switch, and the display screen is electrically connected to the acceleration button. The display screen is provided, and the working speed of the equipment can be displayed through the display screen, so that the staff can observe the driving speed of the equipment.

Preferably, the deceleration button is electrically connected to the display screen, and the adjustment button is electrically connected to the display screen. The deceleration button is provided, through which the speed of the equipment can be adjusted, so that the staff can control the equipment.

Preferably, the inner wall of the upper housing is provided with a vibrating mechanism, the vibrating mechanism comprises a driving motor, and the driving motor is fixedly connected to the inner wall of the upper housing, a driving end of the driving motor is bolted to an eccentric wheel, an inner wall of the eccentric wheel is bolted to a connecting rod, and a surface of the connecting rod is fixedly connected to a storage bin. The driving motor is provided, and the eccentric wheel can be driven to rotate through the driving motor, so that the eccentric wheel can drive the storage bin to move.

Preferably, a cover plate is arranged on an upper surface of the storage bin, a fixing nut is threaded on a surface of the connecting rod, and the inner wall of the lower housing is fixedly connected to a load frame, and a spring is fixedly connected to an inner wall of the load frame. A cover plate is provided, and the storage bin can be sealed through the cover plate in a state restricted by the fixing nut.

Preferably, the connecting rod runs through the upper surface of the storage bin, the connecting rod runs through an upper surface of the cover plate, and the fixing nut is connected against the upper surface of the cover plate, and the spring is hinged with a lower surface of the storage bin. A connecting rod is provided, through which the position of the storage bin can be limited, so as to reduce the probability of loosening of the storage bin.

Compared with the prior art, the advantages and positive effects of the present application are:

In the present application, by setting up the control panel, when grinding stones, putting the stones into the storage bin, covering the cover plate and putting the protective cover on. Then turning on the power switch, the servo motor is energized to drive the eccentric wheel to rotate, and then under the action of the eccentric wheel, the storage bin will vibrate, and the stone placed inside it will be polished; When using the device, long pressing the power switch, the power switch controls the power on of the device. When putting stones into the equipment, short pressing the power switch, and the power switch controls the work of the servo motor with the cooperation of the assembly main board. When the rotation speed of the servo motor needs to be adjusted during operation, pressing the acceleration button, and the acceleration button will speed up the rotation speed of the servo motor with the assistance of the assembly main board. When the speed of the servo motor needs to be reduced, pressing the deceleration button, and the deceleration button cooperates with the assembly main board to reduce the speed of the servo motor. When the staff needs to adjust the timing value of the device, pressing the adjustment button, the ones digit value on the display screen will flash, pressing the adjustment button again, the tens digit value will flash, continue to press the adjustment button, and the hundreds digit value will flash. When each value is flashing, each value can be adjusted through the acceleration button and deceleration button. By setting the control panel, the staff can perform stone grinding operations through the equipment, thereby reducing the problem of high grinding costs caused by manual grinding of stones, improving the grinding efficiency of stones, and improving the grinding effect of stones.

Reference signs: 1. Lower housing; 2. Upper housing; 3. Protective cover; 4. Control panel; 41. Assembly main board; 42. Display screen; 43. Power switch; 44. Acceleration button; 45. Deceleration button; 46. Adjustment button; 5. Vibrating mechanism; 51. Driving motor; 52. Connecting rod; 53. Storage bin; 54. Cover plate; 55. Fixing nut; 56. Load frame; 57. Spring; 16. Eccentric wheel.

DETAILED DESCRIPTION

Figure 1:
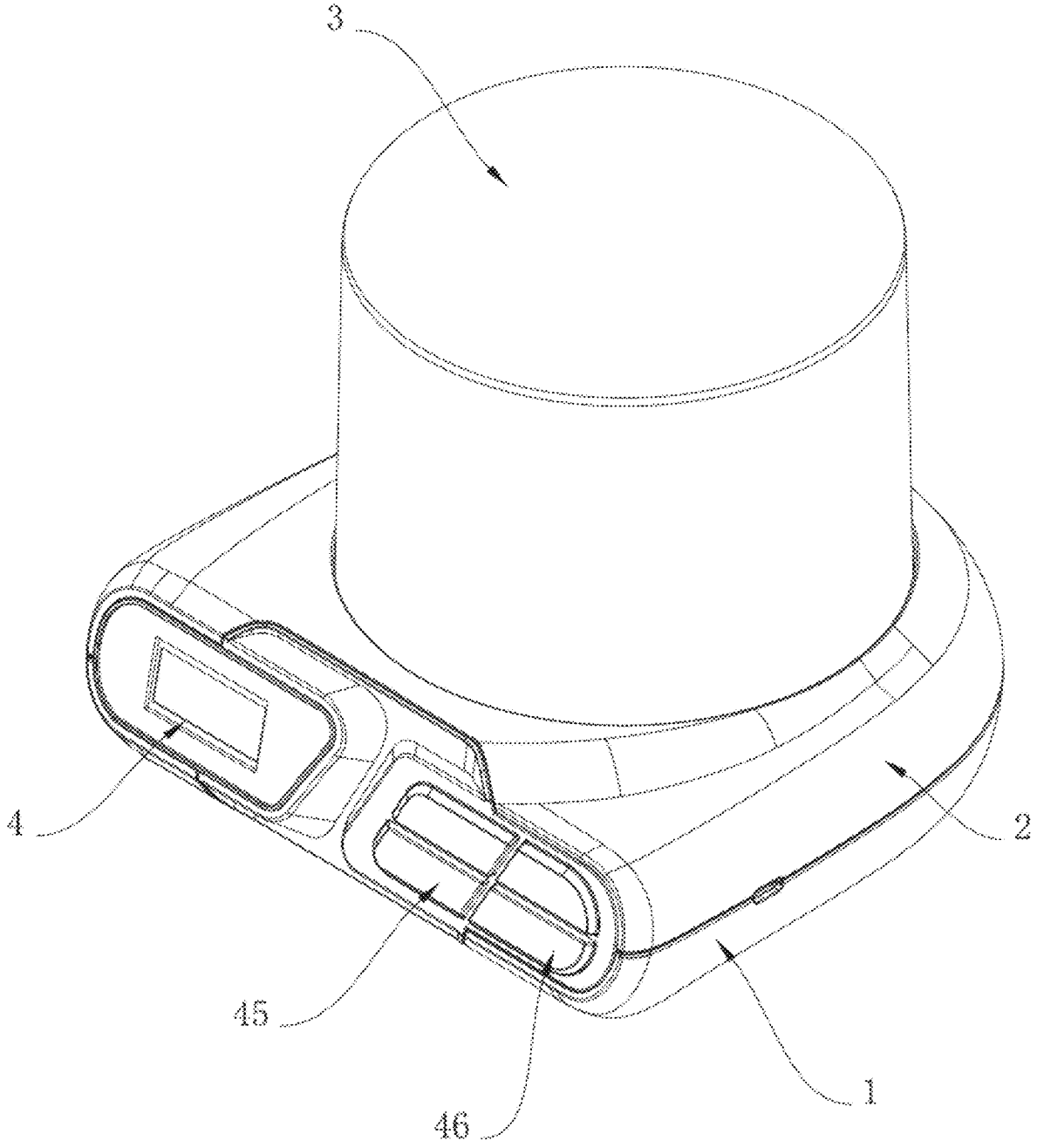
FIG. 1 is a schematic diagram of the three-dimensional structure of the vibrating stone grinder proposed by the present application.
Figure 2:
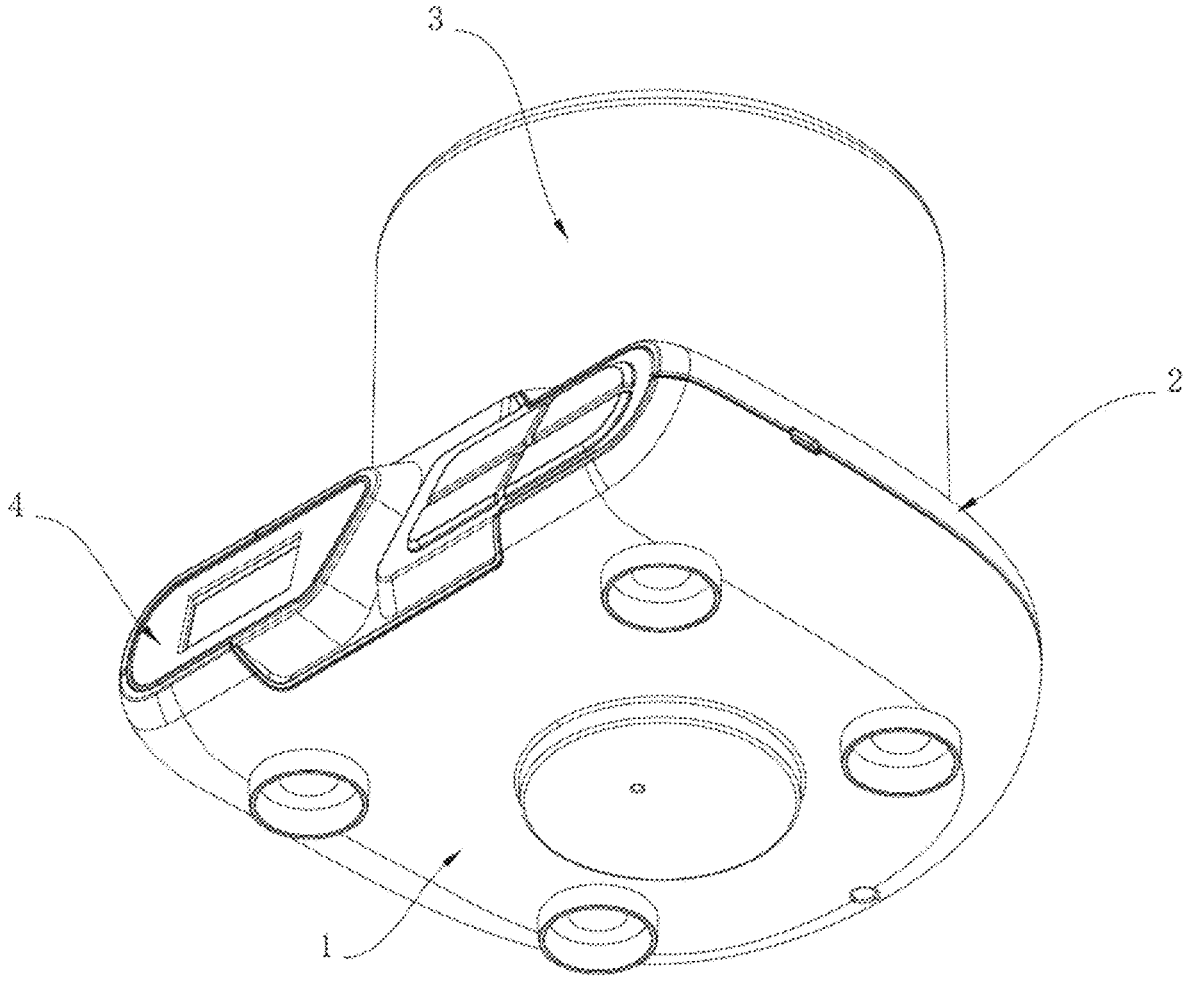
FIG. 2 is a structural diagram of the vibrating stone grinder proposed by the present application shown in the bottom view.
Figure 3:
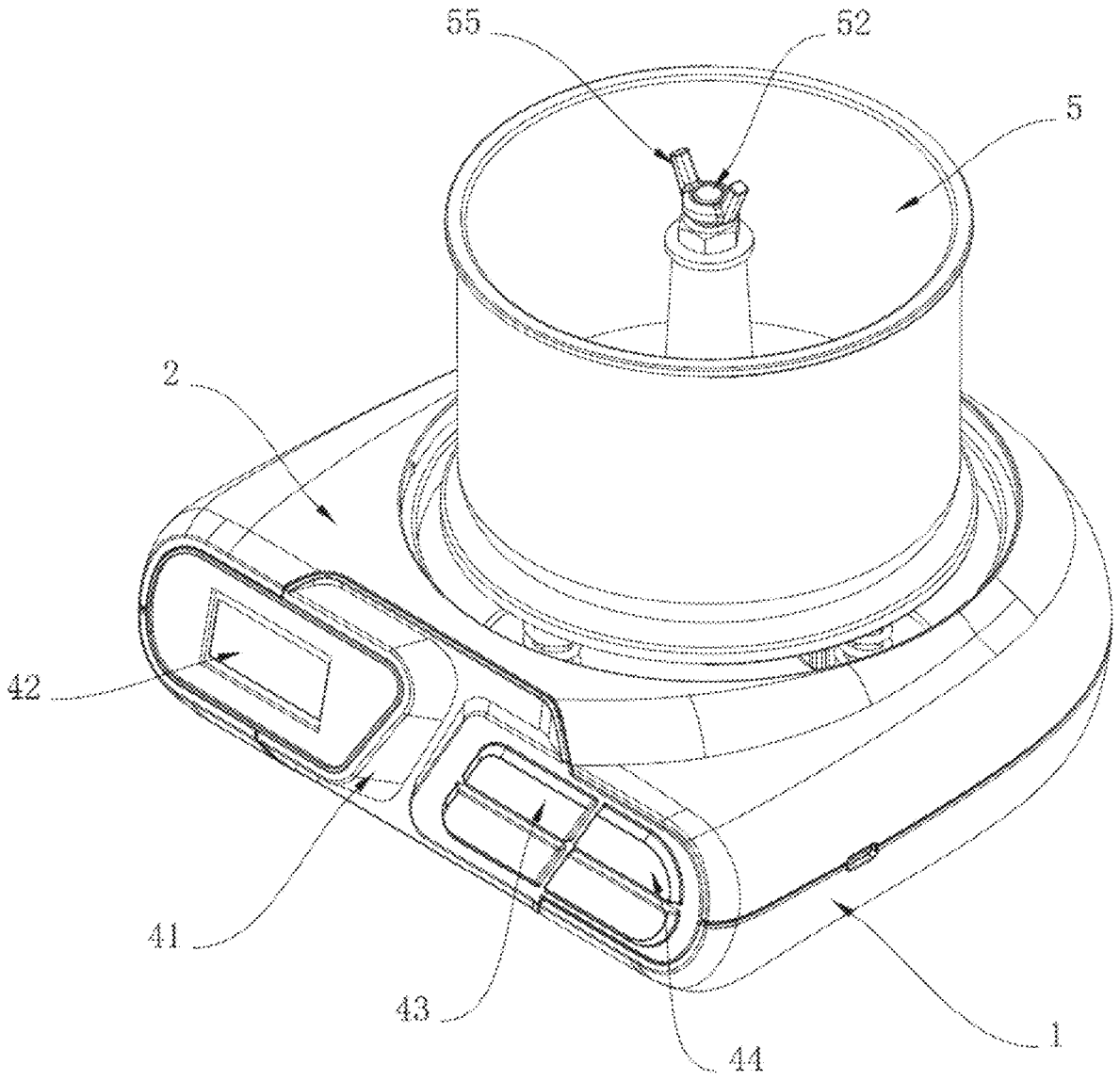
FIG. 3 is the partial structural schematic diagram of the vibrating stone grinder proposed by the present application.
Figure 4:
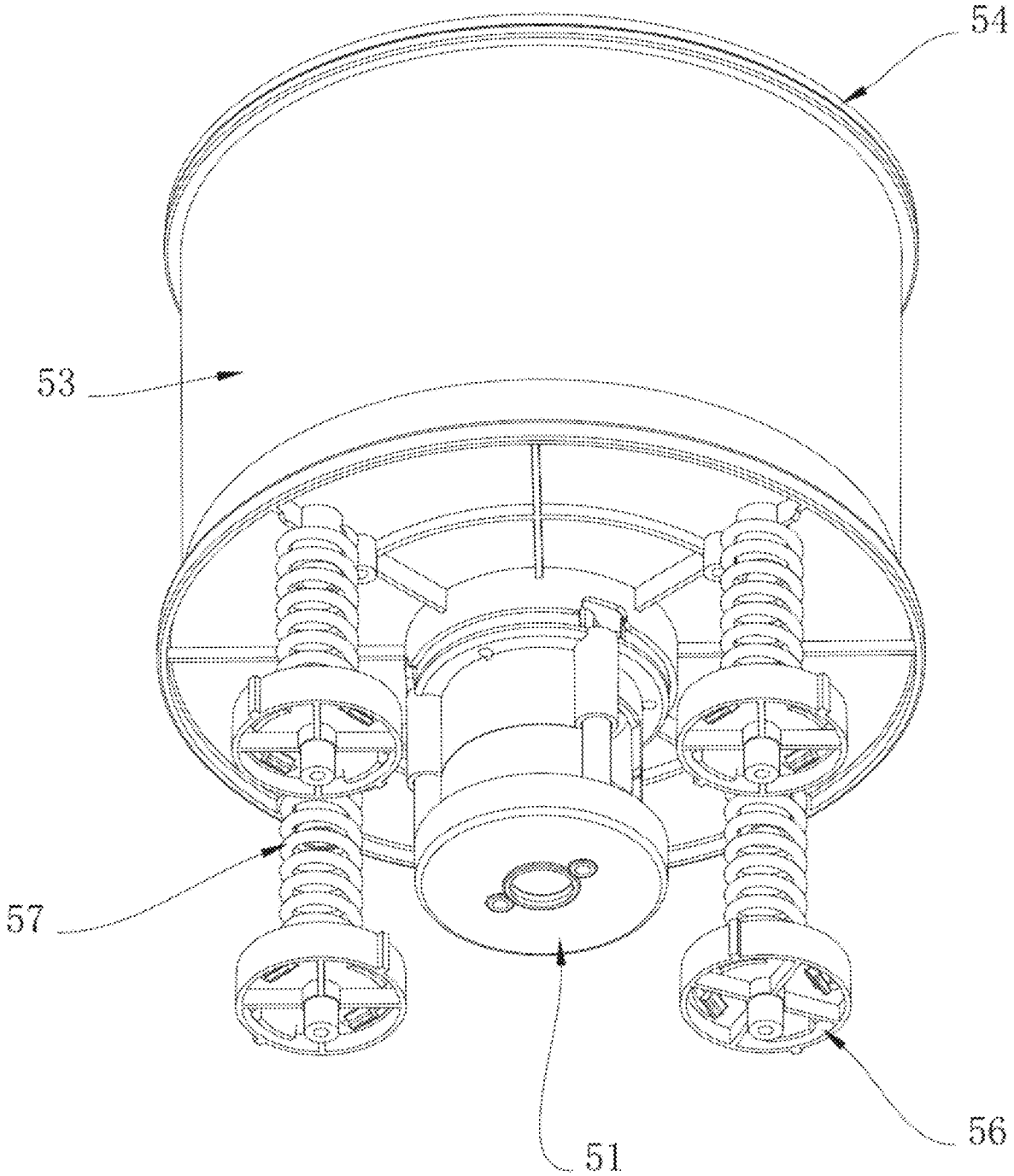
FIG. 4 is a structural schematic diagram of the vibrating mechanism of the vibrating stone grinder proposed by the present application.
Figure 5:
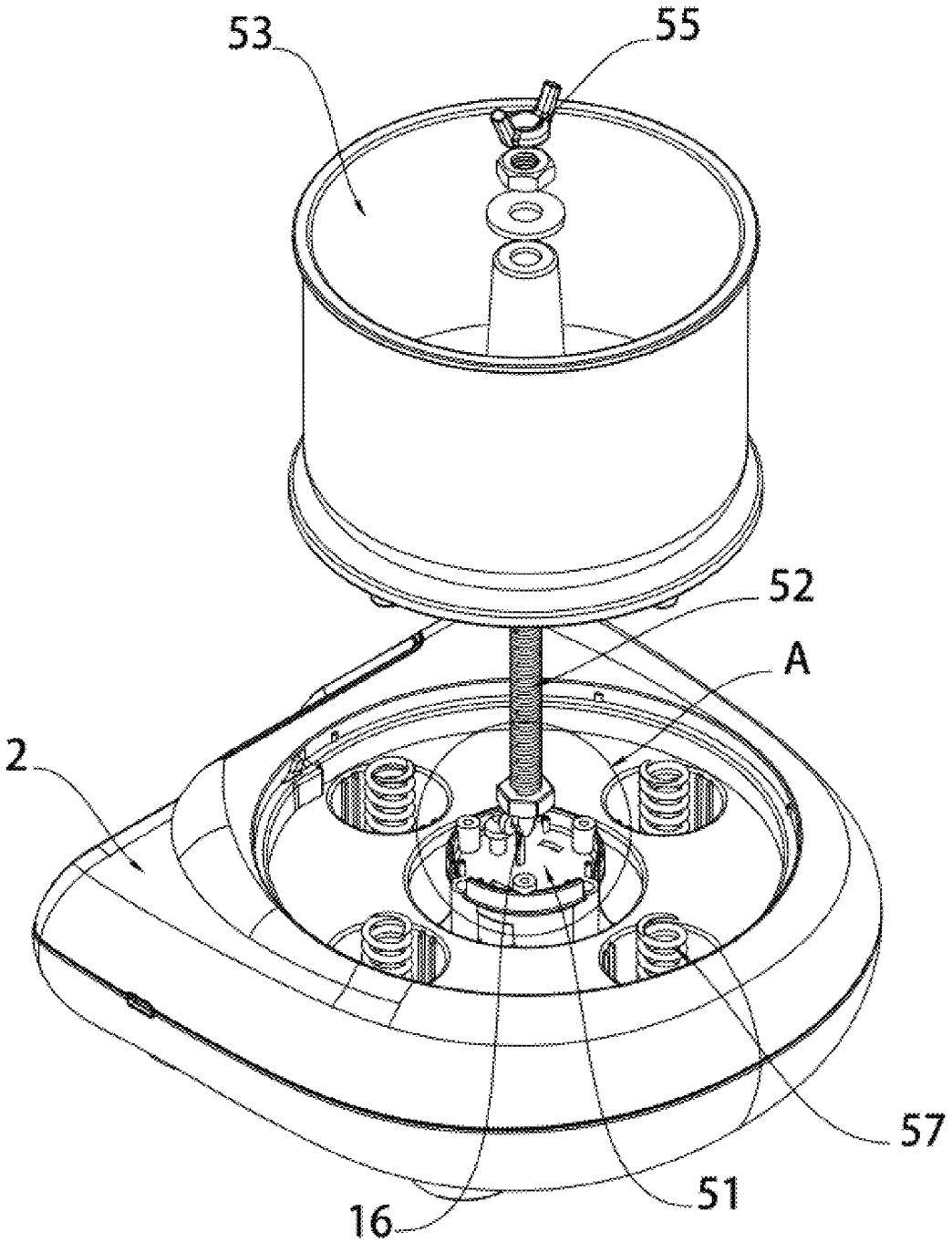
FIG. 5 is a schematic diagram of split structure of the vibrating mechanism of the vibrating stone grinder proposed by the present application.
Figure 6:
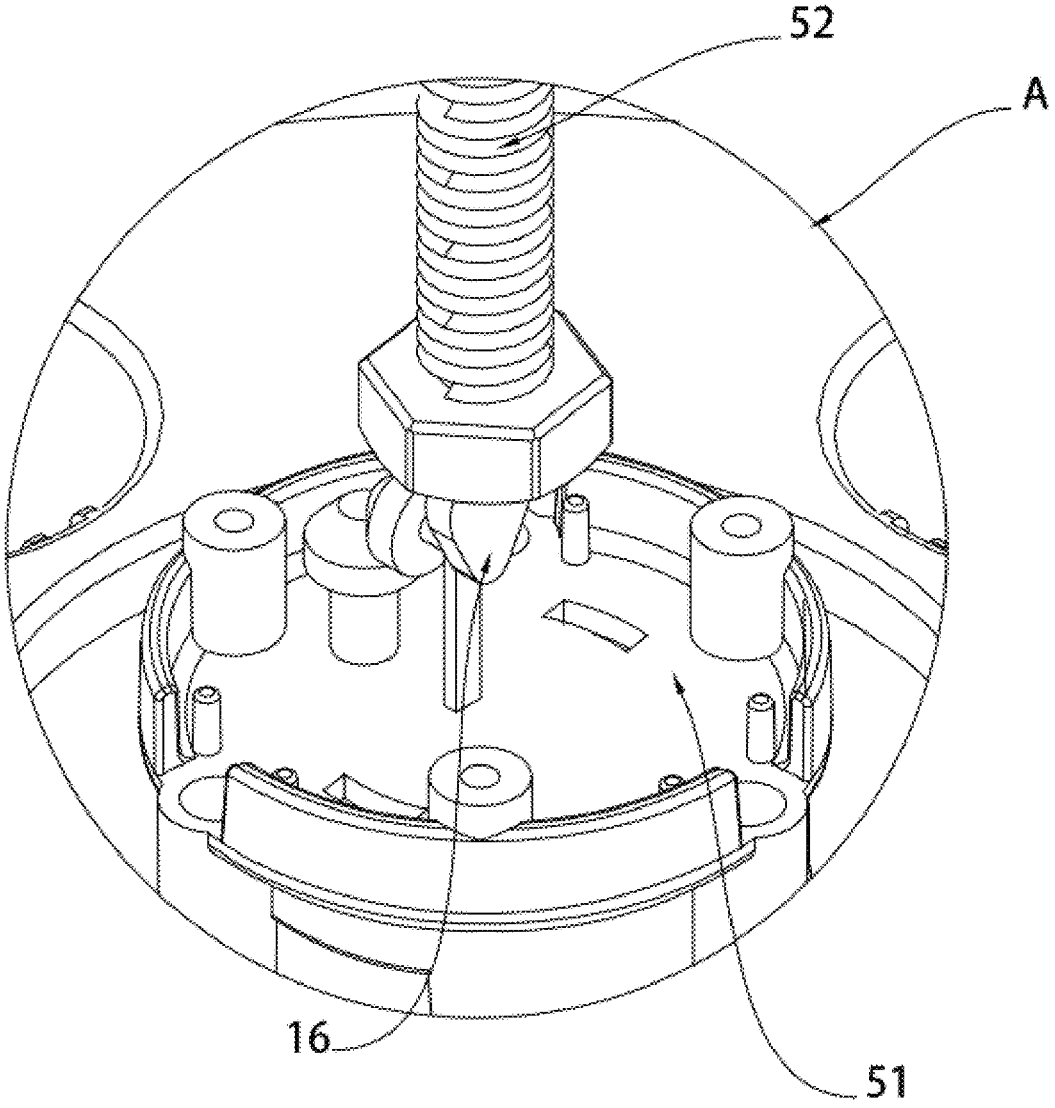
FIG. 6 is a partial enlarged and split structure diagram of the vibrating mechanism of the vibrating stone grinder proposed by the present application.

Please refer to FIGS. 1-6, the present application provides a technical solution: A vibrating stone grinder, comprising a lower housing 1, an upper housing 2 and a control panel 4, wherein the upper housing 1 is fixedly connected to an upper surface of the lower housing 1, a protective cover 3 is arranged on an inner wall of the upper housing 2, and the control panel 4 is arranged at a joint position of the upper housing 2 and the lower housing 1, wherein the inner wall of the upper housing 2 is provided with a vibrating mechanism 5.

Next, the specific settings and functions of the control panel 4 and the vibrating mechanism 5 will be described in detail.

In this embodiment: the control panel 4 comprises a assembly main board 41, the assembly main board 4 is bolted to the inner wall of the lower housing 1, a surface of the assembly main board 41 is fixedly connected with a display screen 42.

Specifically, the surface of the assembly main board 41 is fixedly connected with a power switch 43, the surface of the assembly main board 41 is fixedly connected with an acceleration button 44, and the surface of the assembly main board 41 is fixedly connected with a deceleration button 45, and the surface of the assembled main board 41 is fixedly connected with an adjustment button 46. The power switch 43 is provided, and the running state of the device can be controlled through the power switch 43, so as to realize the work of the device.

Specifically, the display screen 42 is electrically connected to the power switch 43, and the display screen 42 is electrically connected to the acceleration button 44.

In this embodiment, the display screen 42 is provided, and the working speed of the equipment can be displayed through the display screen 42, so that the staff can observe the driving speed of the equipment.

Specifically, the deceleration button 45 is electrically connected to the display screen 42, and the adjustment button 46 is electrically connected to the display screen 42. The deceleration button 45 is provided, the speed of the equipment can be adjusted through the deceleration button 45, so that the staff can control the equipment.

In this embodiment, the vibrating mechanism 5 comprises a driving motor 51, and the driving motor 51 is fixedly connected to the inner wall of the upper housing 2, a driving end of the driving motor 51 is bolted to an eccentric wheel 16, an inner wall of the eccentric wheel 16 is bolted to a connecting rod 52, and a surface of the connecting rod 52 is fixedly connected to a storage bin 53.

In this embodiment, the driving motor 51 is provided, and the eccentric wheel 16 can be driven to rotate through the driving motor 51, so that the eccentric wheel 16 can drive the storage bin 53 to move.

Specifically, a cover plate 54 is arranged on an upper surface of the storage bin 53, a fixing nut 55 is threaded on a surface of the connecting rod 52, and the inner wall of the lower housing 1 is fixedly connected to a load frame 56, and a spring 57 is fixedly connected to an inner wall of the load frame 56. A cover plate 54 is provided, and the storage bin 53 can be sealed through the cover plate 54 in a state restricted by the fixing nut 55.

Specifically, the connecting rod 52 runs through the upper surface of the storage bin 53, the connecting rod 52 runs through an upper surface of the cover plate 54, and the fixing nut 55 is connected against the upper surface of the cover plate 54, and the spring 57 is hinged with a lower surface of the storage bin 53.

In this embodiment, the connecting rod 52 is provided, the position of the storage bin 53 can be limited by the connecting rod 52, so as to reduce the probability of loosening of the storage bin 53

Wording principle: when grinding stones, putting the stones into the storage bin 53, covering the cover plate 54 and putting the protective cover 3 on. Then turning on the power switch 43, the servo motor is energized to drive the eccentric wheel 16 to rotate, and then under the action of the eccentric wheel 16, the storage bin 53 will vibrate, and the stone placed inside it will be polished. When using the device, long pressing the power switch 43, the power switch controls the power on of the device. When putting stones into the equipment, short pressing the power switch 43, and the power switch 43 controls the work of the servo motor with the cooperation of the assembly main board 41. When the rotation speed of the servo motor needs to be adjusted during operation, pressing the acceleration button 44, and the acceleration button 44 will speed up the rotation speed of the servo motor with the assistance of the assembly main board 41. When the speed of the servo motor needs to be reduced, pressing the deceleration button 45, and the deceleration button 45 cooperates with the assembly main board 41 to reduce the speed of the servo motor. When the staff needs to adjust the timing value of the device, pressing the adjustment button 46, the ones digit value on the display screen will flash, pressing the adjustment button 46 again, the tens digit value will flash, continue to press the adjustment button 46, and the hundreds digit value will flash. When each value is flashing, each value can be adjusted through the acceleration button 44 and deceleration button 45. By setting the control panel 44, the staff can perform stone grinding operations through the equipment, thereby reducing the problem of high grinding costs caused by manual grinding of stones, improving the grinding efficiency of stones, and improving the grinding effect of stones. In addition, by providing the vibrating mechanism 5, when the stone is put into the storage bin 53, the cover plate 54 is covered and the fixing nut 55 is tightened. When the fixing nut 55 is tightened, the protective cover 3 is installed, and then the driving motor 51 can be controlled by the control panel 4 to work. The drive motor 51 is energized to drive the eccentric wheel 16 to rotate, and the eccentric wheel 16 generates centrifugal force in the process of rotation, and then under the action of the eccentric wheel 16, the storage bin 53 is driven to generate vibration. The storage bin 53 will drive the stones and grinding materials inside to shake during the vibration process, and the stones will be polished by the grinding materials in the process of friction with the grinding materials, and then the grinding operation of the materials will be completed. Simultaneously when the equipment is working, when the protective cover 3 is taken off, the equipment will automatically pause, and the display screen 42 will enter the flashing state simultaneously. When the device is powered off and stops working, and then calls back, the device will automatically resume working. By providing the vibrating mechanism 5, the grinding operation of the stone is facilitated, thereby reducing the difficulty of grinding the stone, and further improving the processing efficiency of the stone.

What is claimed is:

1. A vibrating stone grinder, comprising:

a lower housing (1), an upper housing (2), and a control panel (4), wherein the upper housing (1) is fixedly connected to an upper surface of the lower housing (1), and the control panel (4) is arranged at a joint position of the upper housing (2) and the lower housing (1), wherein the control panel (4) comprises an assembly main board (41), the assembly main board (4) is bolted to an inner wall of the lower housing (1), a surface of the assembly main board (41) is fixedly connected with a display screen (42);

wherein an inner wall of the upper housing (2) is provided with a vibrating mechanism (5), the vibrating mechanism (5) comprises a driving motor (51), and the driving motor (51) is fixedly connected to the inner wall of the upper housing (2), a driving end of the driving motor (51) is bolted to an eccentric wheel, an inner wall of the eccentric wheel is bolted to a connecting rod (52), and a surface of the connecting rod (52) is fixedly connected to a storage bin (53);

wherein a cover plate (54) is arranged on an upper surface of the storage bin (53), a fixing nut (55) is threaded on a surface of the connecting rod (52), a protective cover (3) is arranged above the cover plate (54), and the inner wall of the lower housing (1) is fixedly connected to a load frame (56), and a spring (57) is fixedly connected to an inner wall of the load frame (56), the spring (57) is hinged with a lower surface of the storage bin (53).

2. The vibrating stone grinder according to claim 1, wherein the surface of the assembly main board (41) is fixedly connected with a power switch (43), the surface of the assembly main board (41) is fixedly connected with an acceleration button (44), and the surface of the assembly main board (41) is fixedly connected with a deceleration button (45), and the surface of the assembled main board is fixedly connected with an adjustment button (46).

3. The vibrating stone grinder according to claim 2, wherein the display screen (42) is electrically connected to the power switch (43), and the display screen (42) is electrically connected to the acceleration button (44).

4. The vibrating stone grinder according to claim 2, wherein the deceleration button (45) is electrically connected to the display screen (42), and the adjustment button (46) is electrically connected to the display screen (42).

5. The vibrating stone grinder according to claim 1, wherein the connecting rod (52) runs through the upper surface of the storage bin (53), the connecting rod (52) runs through an upper surface of the cover plate (54), and the fixing nut (55) is connected against the upper surface of the cover plate (54).

* * * * *